US007511431B2

(12) United States Patent
Lesch et al.

(10) Patent No.: US 7,511,431 B2
(45) Date of Patent: Mar. 31, 2009

(54) GAS DISCHARGE LAMP

(75) Inventors: Norbert Lesch, Vaals (NL); Willebrordus Gerardus Traa, Leende (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 182 days.

(21) Appl. No.: 10/549,347

(22) PCT Filed: Mar. 9, 2004

(86) PCT No.: PCT/IB2004/000792

§ 371 (c)(1), (2), (4) Date: Sep. 14, 2005

(87) PCT Pub. No.: WO2004/083900

PCT Pub. Date: Sep. 30, 2004

(65) Prior Publication Data

US 2006/0170360 A1 Aug. 3, 2006

(30) Foreign Application Priority Data

Mar. 18, 2003 (EP) ..... 03100687

(51) Int. Cl.
*H01J 7/44* (2006.01)

(52) U.S. Cl. ..... 315/56; 313/634; 313/637

(58) Field of Classification Search ..... 315/56–58, 315/248, 70, 246; 313/281–285, 251, 252, 313/291, 634–637

See application file for complete search history.

(56) References Cited

U.S. PATENT DOCUMENTS

| | | | | |
|---|---|---|---|---|
| 3,649,864 | A * | 3/1972 | Willemsen | 313/622 |
| 3,758,819 | A * | 9/1973 | Goldberg | 315/204 |
| 5,343,370 | A | 8/1994 | Ohashi et al. | 315/291 |
| 5,397,966 | A * | 3/1995 | Vrionis et al. | 315/248 |
| 5,869,931 | A * | 2/1999 | Terada | 313/607 |
| 6,198,223 | B1 * | 3/2001 | Scholz | 313/623 |
| 6,304,028 | B1 * | 10/2001 | Vollkommer et al. | 313/491 |
| 6,459,203 | B1 * | 10/2002 | Kim | 315/56 |

FOREIGN PATENT DOCUMENTS

| | | |
|---|---|---|
| DE | 19753610 A1 | 6/1999 |
| GB | 2105515 A | 3/1983 |

* cited by examiner

*Primary Examiner*—Douglas W Owens
*Assistant Examiner*—Jimmy T Vu

(57) ABSTRACT

A gas discharge lamp (1) is described with a discharge vessel (2) and electrodes (4, 5) projecting into the discharge vessel (2). The gas discharge lamp (1) is provided with a translucent, electrically conductive screening (9, 23) which screens the discharge vessel (2) and which comprises connection means (7, 10, 24, 27, 28). The screening (9, 23) of the gas discharge lamp (1) is connected to a screening (14, 17, 19) of an electrical system used for operating the gas discharge lamp (1) at least as regards high frequencies so as to form a coaxial screening system that encloses the discharge vessel (2) with its electrodes (4, 5).

16 Claims, 10 Drawing Sheets

GAS DISCHARGE LAMP

Figure 1:
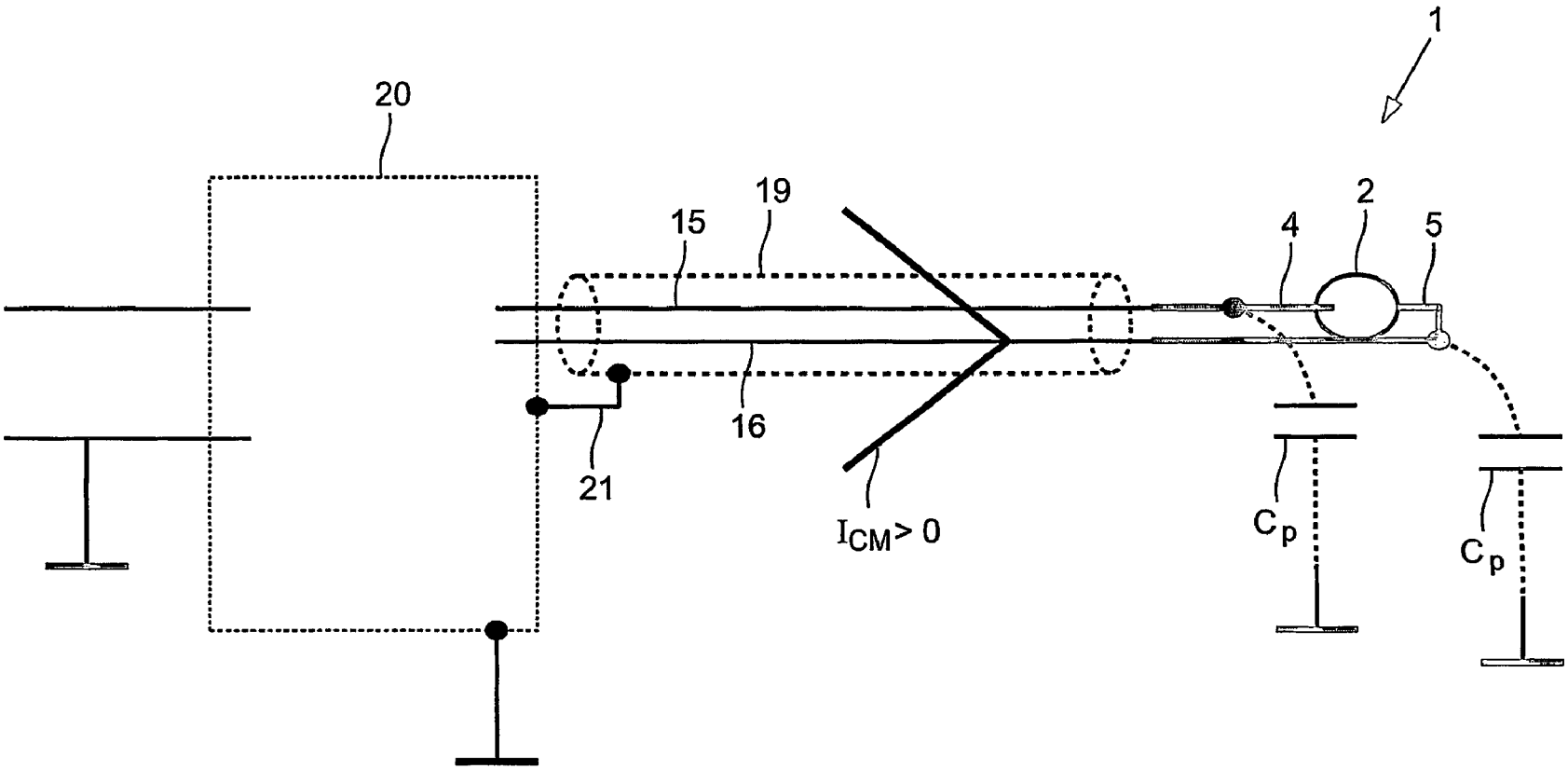
FIG.1 Prior art

The invention relates to a gas discharge lamp and to a headlight, in particular a vehicle headlight, or a luminaire with a corresponding gas discharge lamp.

Gas discharge lamps have been used ever more widely for a number of years in the vehicle headlight industry because of their excellent light emission efficiency and color characteristics as well as their long operational lives. Such gas discharge lamps have a discharge vessel which is filled with an inert gas and which is made from a translucent, heat-resistant material, for example from quartz glass. Electrodes project into this discharge vessel, and a voltage is applied to these electrodes for ignition and for operation of the lamp. Typical gas discharge lamps used nowadays in motor vehicles are, for example, so-termed HID (High Intensity Discharge) lamps such as, for example, high-pressure sodium lamps, and in particular MPXL (Micro Power Xenon Light) lamps, which operate with a filling of xenon gas. A problem in the use of such gas discharge lamps is, however, that the physical properties of the respective inert gas, for example the xenon gas, and the discharge phenomenon resulting therefrom cause the discharge lamp to emit not only the desired light, but also a high proportion of wide-band electromagnetic interference radiation in a range of up to 1 GHz. The undesired electromagnetic radiation is primarily radiated from the electrodes and supply lines to the discharge tube, acting as antennas driven by the discharge vessel in its operational state. This radiation can also be described in the form of a so-called common mode current, which corresponds to the difference between the current supplied to the lamp and the current returned from the lamp. This high-frequency interference current flows through parasitic capacitances between the lamp and the surroundings, for example a headlight reflector, towards the surroundings. Since this interference radiation leads to electromagnetic interference with other electronic units of a vehicle such as, for example, an audio set, an ABS, an airbag control, etc., and could consequently lead to malfunctions in the relevant devices, there are legal EMC (electromagnetic compatibility) requirements as well as comparatively stringent EMC requirements set by the automobile industry itself, for example CISPR25. It is accordingly highly necessary to reduce the undesirably radiated electromagnetic energy. The possibilities for modifying the interference source itself, i.e. the lamp itself, such that it radiates less electromagnetic energy in the relevant range, are very limited because of the fundamental physical properties of the lamp and the power requirements imposed on the lamp. This is why measures to improve the EMC are usually taken such that the electromagnetic interference emission is prevented from being radiated into the surroundings.

A usual method of reducing the electromagnetic interference radiation is nowadays that the entire lamp is screened off as well as possible inside the headlight, for example in that the reflector or additional screening parts inside the lamp are grounded, as is described in U.S. Pat. No. 5,343,370. Such a screening of the lamp and its supply lines by means of metal or other conductive components of the headlight, however, is comparatively complicated and accordingly expensive. In addition, the requirement of an optimized screening of the lamp by the headlight leads to additional boundary conditions for the design of the headlight, which may hamper an optimization of the headlight in regard of other aspects, such as the radiant behavior or the light output.

It is accordingly an object of the present invention to provide a gas discharge lamp which emits electromagnetic interference radiation at least to a low degree during operation.

This object is achieved by means of a gas discharge lamp which comprises in addition to a discharge vessel with electrodes projecting into the discharge vessel a translucent, electrically conductive screening which screens the discharge vessel and comprises connection means for providing an at least high-frequency connection of the screening to a screening of an electrical system used for operating the gas discharge lamp so as to form a coaxial screening system enclosing the discharge vessel with the electrodes during operation of the gas discharge lamp. An "at least high-frequency" connection is to be understood hereinafter as a connection through which high-frequency currents can flow, such as, for example, a metal-to-metal connection or a suitable high-pass or band-pass filter, for example a capacitive element. In most practical applications of the gas discharge lamp such as, for example, in motor vehicle headlights, the screening of the electronic lamp system is at ground potential. Accordingly, the coaxial screening system of the gas discharge lamp according to the invention will have an at least high-frequency connection to a ground potential in the majority of cases.

The use of a translucent screening which screens off the discharge vessel substantially entirely and which, being part of the gas discharge lamp, is very close to the discharge vessel and the high-frequency connection of this screening to the screening of the remaining electrical system cause the parasitic capacitances to be connected to the screening of the remaining electrical system. The HF interference current accordingly flows through the screening back to the electrical system, so that the common mode current, and thus the correspondingly emitted interference radiation, are substantially fully eliminated. The coupling wherein the screening of the gas discharge lamp together with the screening of the electrical system used for operating the gas discharge lamp forms a coaxial screening system enclosing the discharge vessel with the electrodes provides an excellent high-frequency connection, so that a correspondingly effective screening of the electromagnetic interference radiation is safeguarded. A simple coupling of a screening of a gas discharge lamp to the screening of the electronic system of the lamp via usual wires or thin conductors, however, would lead to too high a self-inductance with a correspondingly high impedance for the HF interference current.

In a particularly preferred embodiment, the screening of the lamp comprises a layer of conductive translucent material, for example FTO, or a grid structure of conductive material, for example a metal, which is arranged in or on a wall, for example on the inner or outer side of the wall of an outer bulb surrounding the discharge vessel. Most types of gas discharge lamps used nowadays have an outer bulb anyway which surrounds the discharge vessel and is usually fixedly connected to the discharge vessel, which bulb serves to screen off the UV radiation generated by the gas discharge lamp. This outer bulb is present very close to the discharge vessel and fully encloses the discharge vessel, so that a screening provided in or on the outer bulb is thus also close to the discharge vessel and screens off the discharge vessel substantially fully. Such a screening on or in the wall of the outer bulb can be manufactured in a comparatively inexpensive and simple manner.

There are various possibilities in principle for achieving a suitable, at least high-frequency coupling between the screening of the gas discharge lamp and the screening of the remaining electronic system, depending inter alia on the manner in which the supply lines for connecting the electrodes to the electronic system of the lamp are constructed.

In a preferred embodiment, the screening and the connection means are arranged such that the screening has an at least high-frequency connection during operation to the screening of the electrical system used for operating the gas discharge lamp in two mutually opposed locations of the gas discharge lamp.

In a preferred modification, at least one of the electrodes is electrically connected to a supply line comprising a screening, for example the central lead of a coaxial line. The screening of the gas discharge lamp is then connected with electrical connection to the screening associated with the supply line, i.e. the outer conductor of the coaxial line. Similarly, however, both electrodes of the gas discharge lamp may be connected to respective supply lines which have similar screenings. The screenings of the two supply lines are then each connected to the screening of the gas discharge lamp, so that the gas discharge lamp can be regarded as part of a continuous coaxial line, wherein the screening of the coaxial line is connected to the screening of the gas discharge lamp, and the central lead of the coaxial line is interrupted by the electrodes of the gas discharge lamp.

Depending on the construction of the mounting of the gas discharge lamp, the screening of the gas discharge lamp may also be directly connected with electrical conduction to a screening of the lampholder during operation. Suitable for this is, for example, a metal lamp starter housing or one provided with an electrically conductive coating, which at the same time provides a lampholder for inserting the gas discharge lamp into the headlight. This modification has the advantage that the starter circuit is inevitably included in the coaxial screening system.

In a further preferred alternative, one of the electrode supply lines is guided inside the screening of the gas discharge lamp, preferably parallel to the electrodes. The screening of the gas discharge lamp in this alternative is connected with electrical conduction to the screening of the electrical system at one side only, for example at the lampholder side. Particularly preferred here is that the screening of the gas discharge lamp is fully closed up to the contact location with the lampholder, where the supply lines for the electrodes are passed into the lampholder, so that accordingly the discharge vessel is fully surrounded by the screening material.

In an alternative preferred embodiment, the screening of the gas discharge lamp itself constitutes a supply line which is electrically connected to one of the electrodes. This embodiment is comparatively economical, because no separate screened supply line is required. Since the operation of modern gas discharge lamps usually takes place with an alternating current between the peak values of 12 V and −73 V at a frequency of 250 to 1000 Hz, often 400 Hz, the screening serving as a return line cannot be directly connected to the screening of the electronic system for the lamp, which is usually at ground potential. In such a system, therefore, a merely high-frequency coupling is provided with the screening of the electronic system via suitable capacitive elements, for example one or several coupling capacitors. The screening of the lamp is then connected to a supply line leading to the electronic lamp system inside a lampholder.

Since the screening of the gas discharge lamp must be constructed such that a sufficient translucence is obtained, the conductivity of the screening will generally be comparatively low. In a preferred modification of the embodiment mentioned last, accordingly, the electrode connected to the screening serving as a supply line is additionally connected to a supply line arranged in parallel to the screening of the gas discharge lamp, for example a wire or a conductor track arranged on the inner or outer side of the outer bulb. In this construction, the lower self-induction will cause the high-frequency currents to drain off through the screening of the lamp, which is high-frequency coupled to the screening of the electrical system via the decoupling capacitors. By contrast, the low-frequency currents forming the major portion of lamp power will flow through the parallel thin conductor, which has a low resistance but a comparatively high self-inductance, and accordingly a high impedance for the HF currents. It is avoided thereby that the resistance of the supply line to the electrode connected to the screening is too low, in particular during the ignition phase in which a high voltage is applied to the electrodes.

In this modification, an inductive element, for example a ferrite bead or a similar element, is preferably included in the additional return line. This inductive element serves as an additional low-pass filter which ensures that substantially exclusively the low-frequency currents will flow through the parallel supply line.

In a further, particularly preferred embodiment, the screening of the gas discharge lamp serving as a supply line for the one electrode is additionally connected to the other electrode via a capacitive component. This capacitive component provides a HF short-circuit between the electrodes and thus further reduces the electromagnetic interference emission.

The gas discharge lamp according to the invention may be used in principle in any headlights or luminaires, as desired. These merely have to comprise the relevant connection means for ensuring that the screening of the gas discharge lamp is connected to the screening of the electronic system so as to form the coaxial screening system enclosing the discharge vessel with the electrodes when the screening of the gas discharge lamp is coupled to the connection means. This means that, for example, suitable contacts need only be present on a lampholder. Additional special constructions of the headlight aimed at screening off the gas discharge lamp in the headlight by means of the reflector and further additional screening parts are not necessary. The small physical distance between the screening present at the gas discharge lamp itself and the discharge vessel forming the interference source provides a particularly effective screening power here.

It is noted for completeness' sake that the use of a gas discharge lamp according to the invention is possible also in headlights that do comprise additional screening means.

Figure 2:
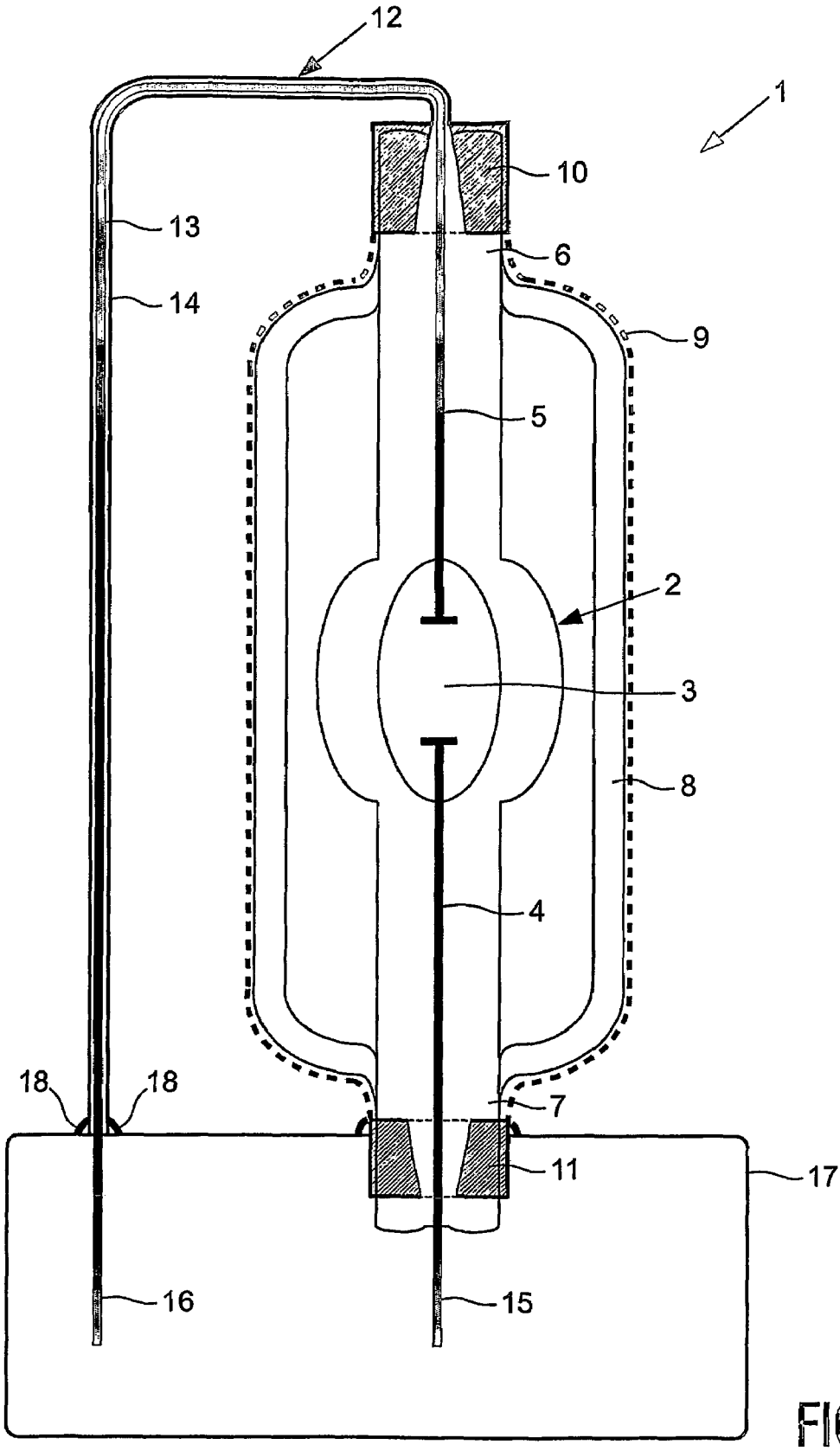
Figure 3:
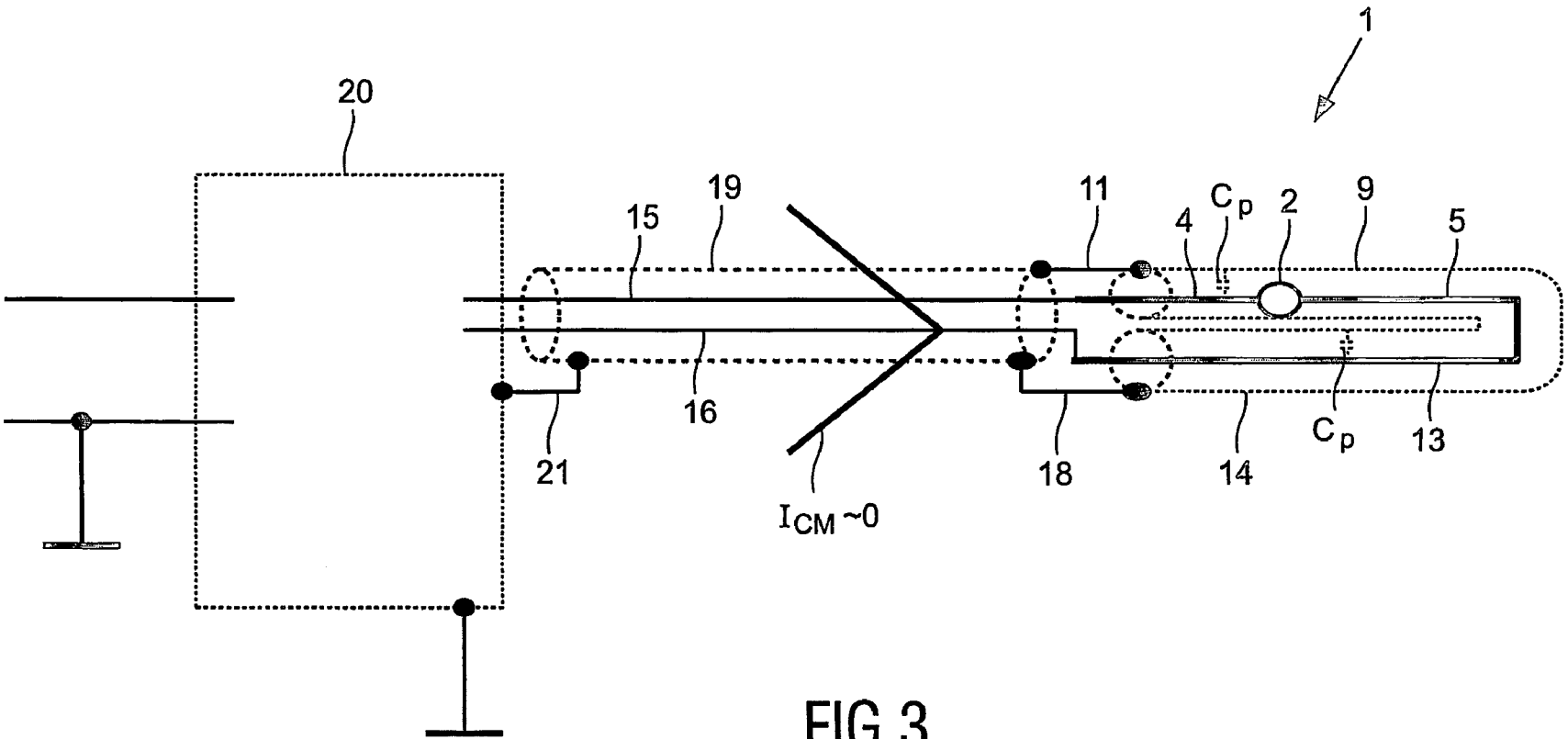
Figure 4:
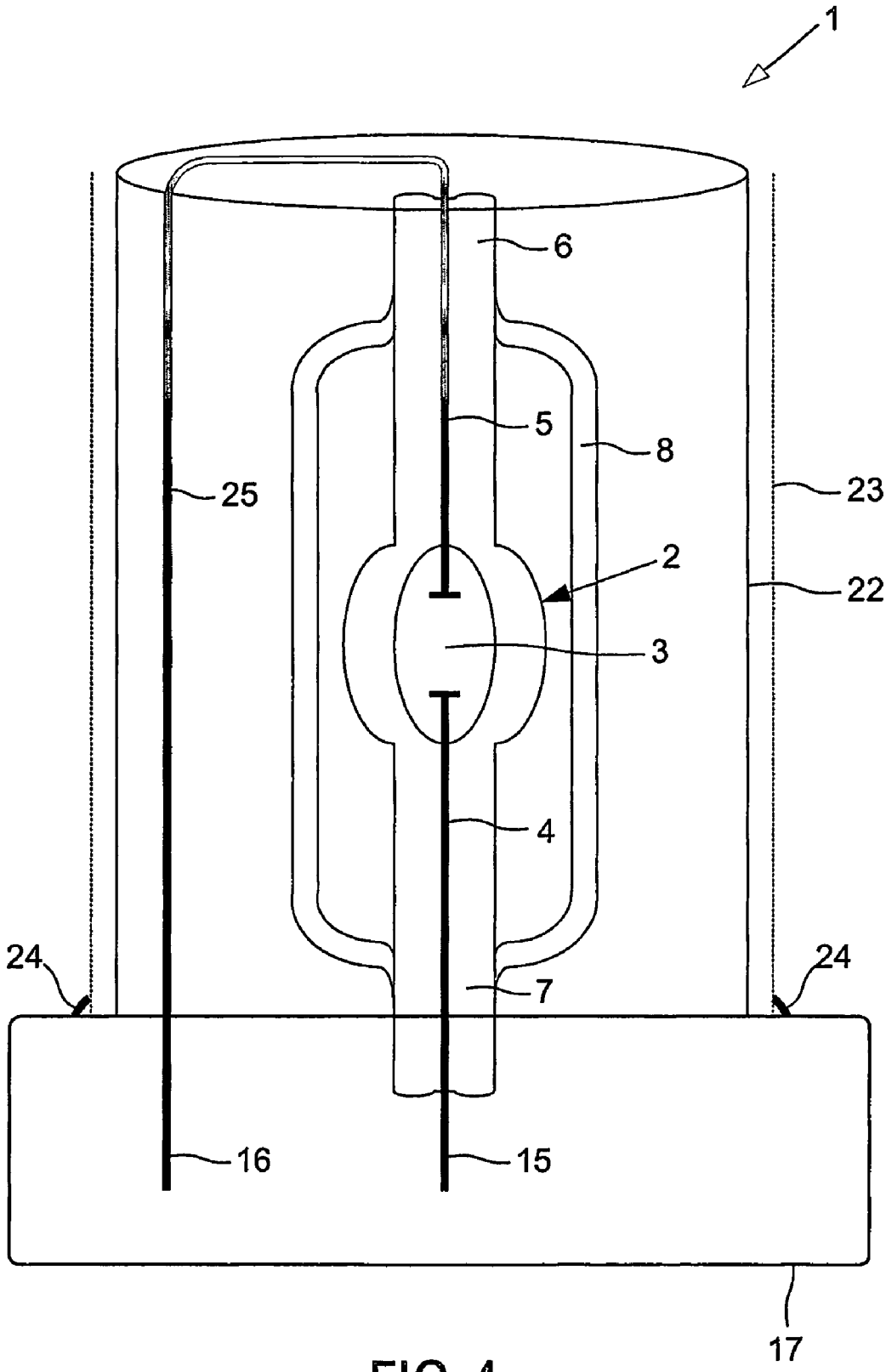
Figure 5:
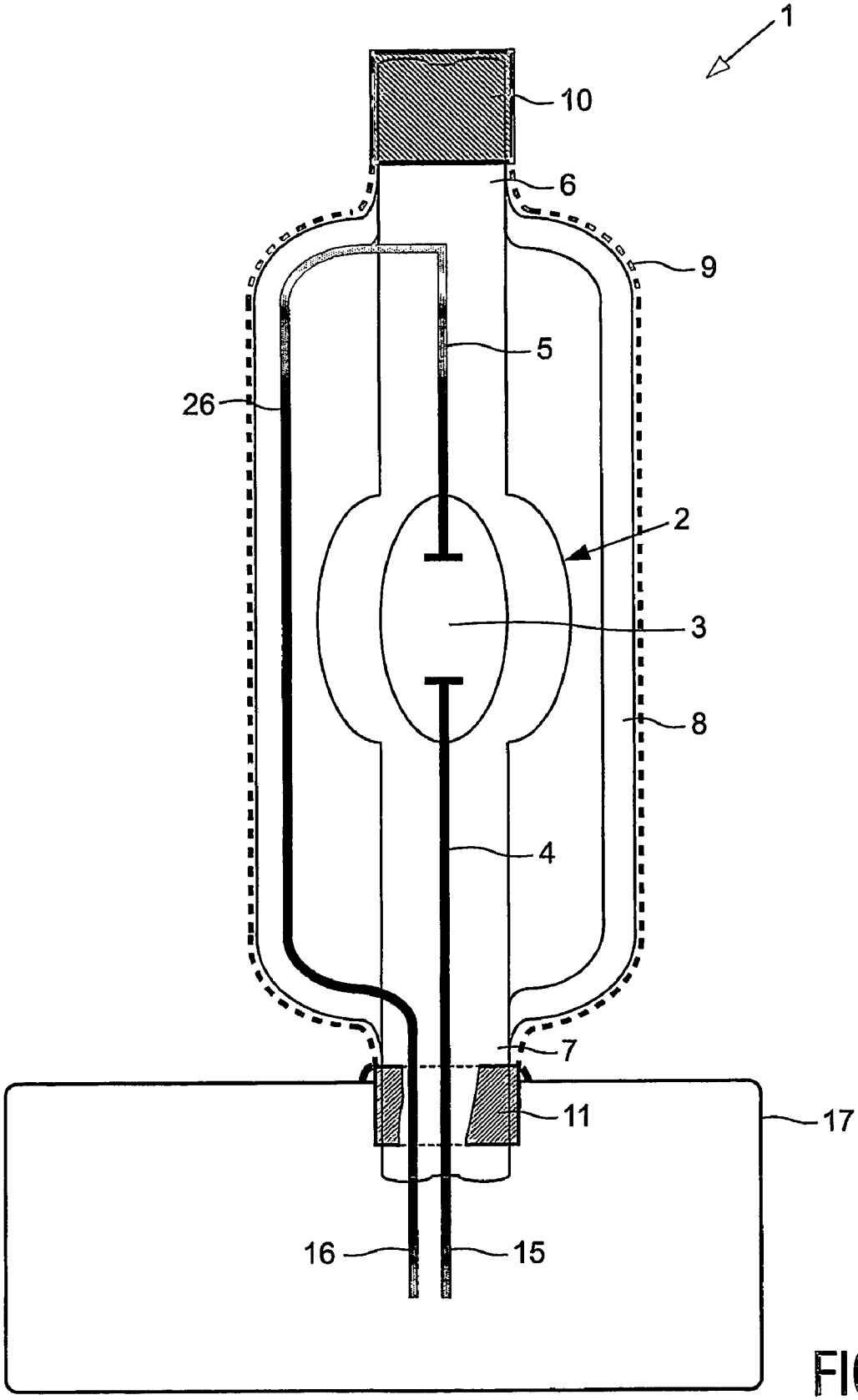
Figure 6:
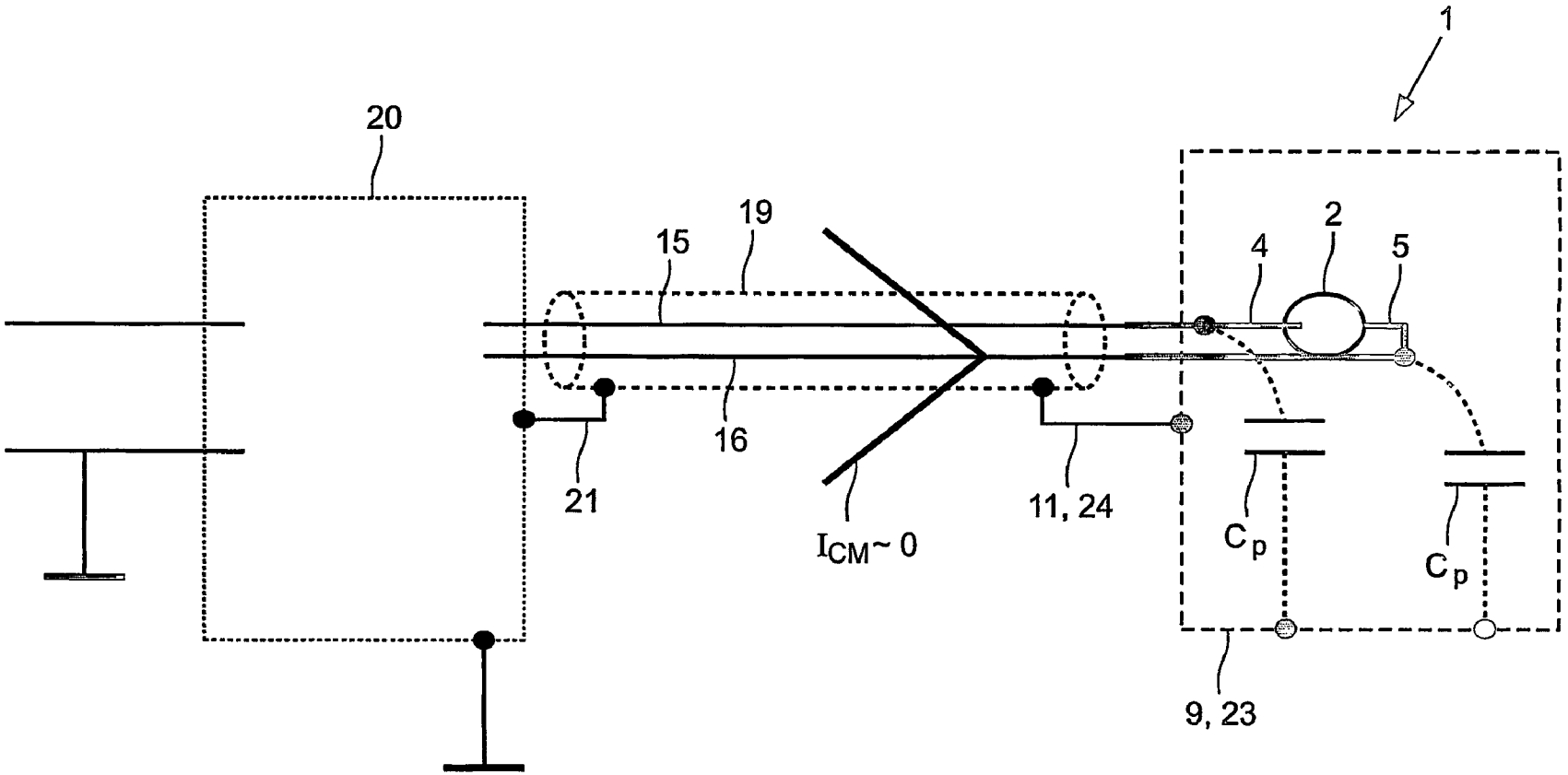
Figure 7:
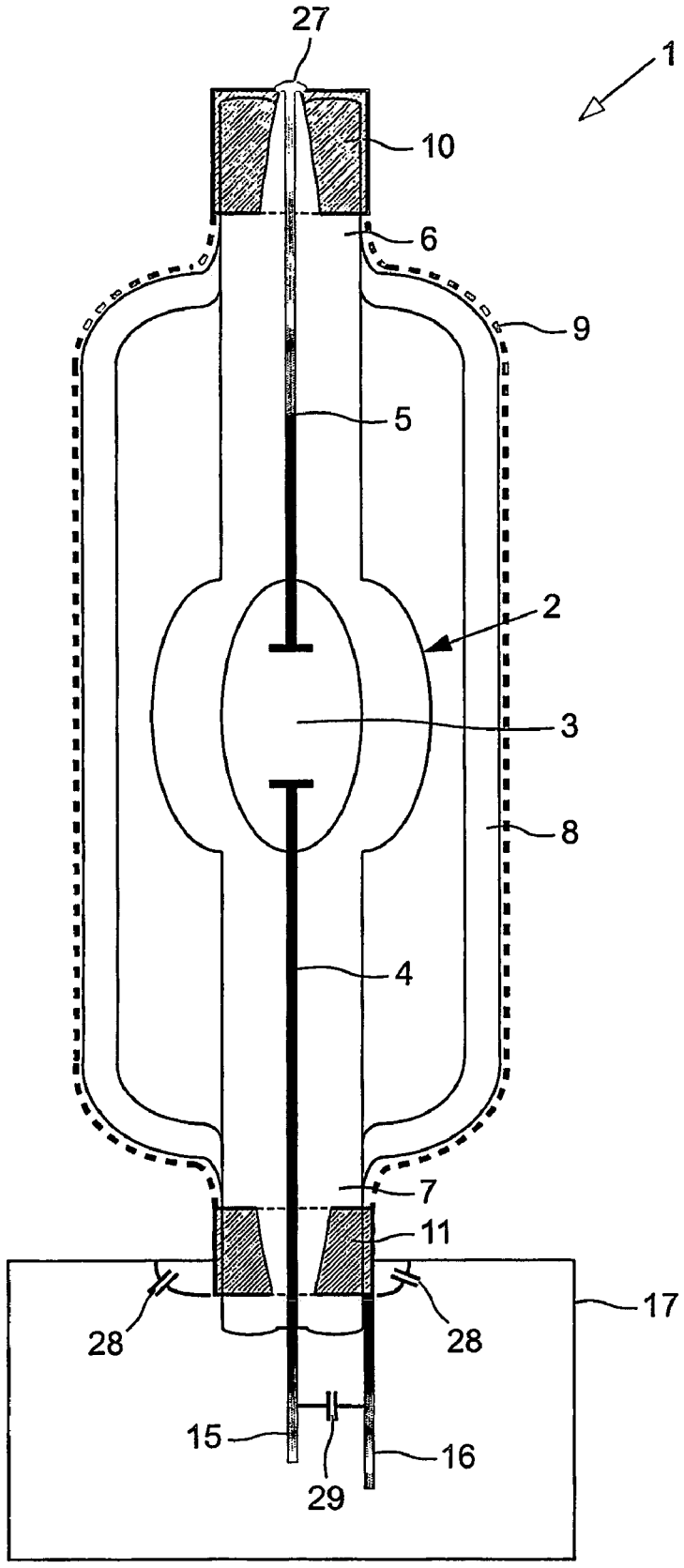
Figure 8:
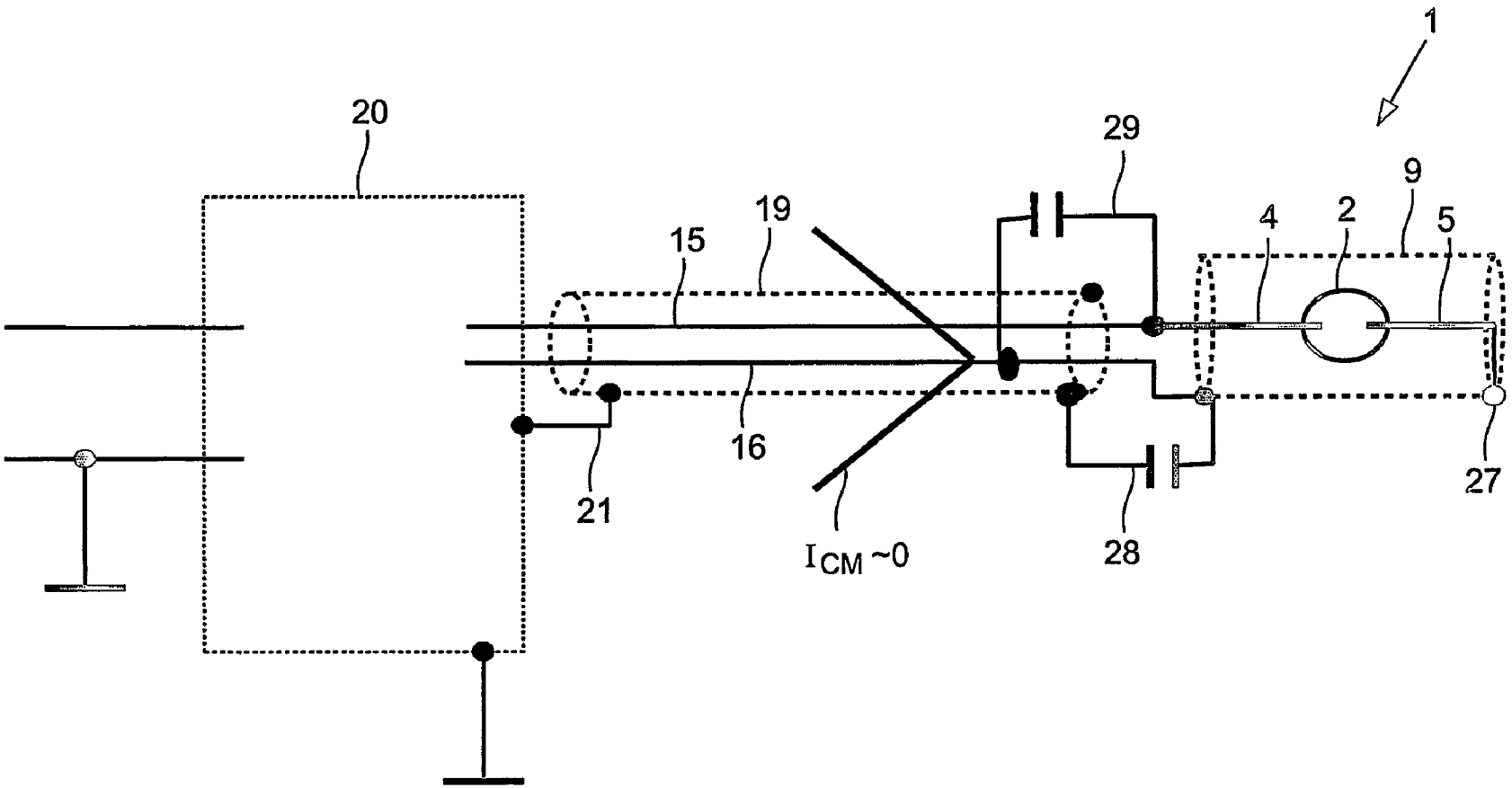
Figure 9:
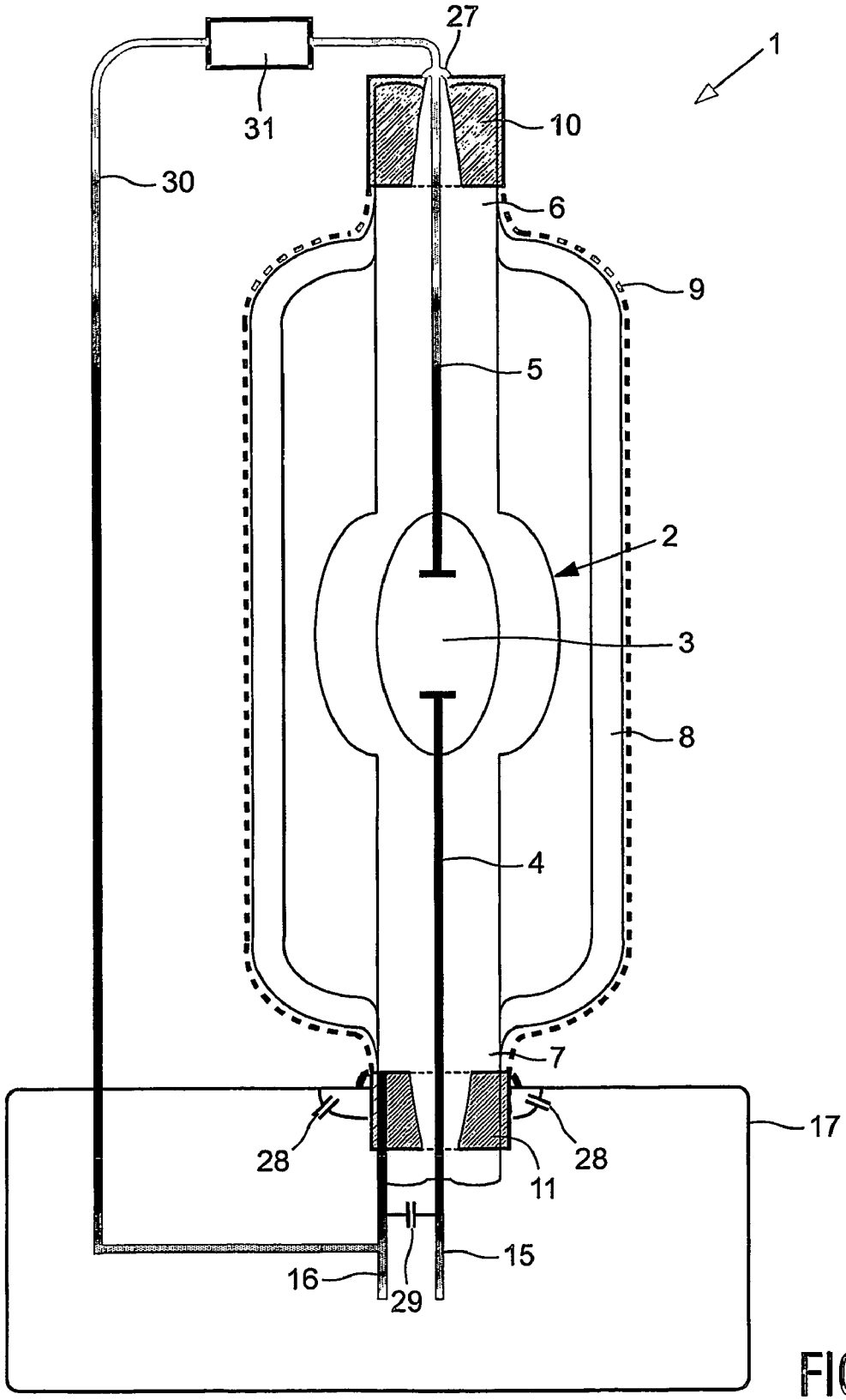
Figure 10:
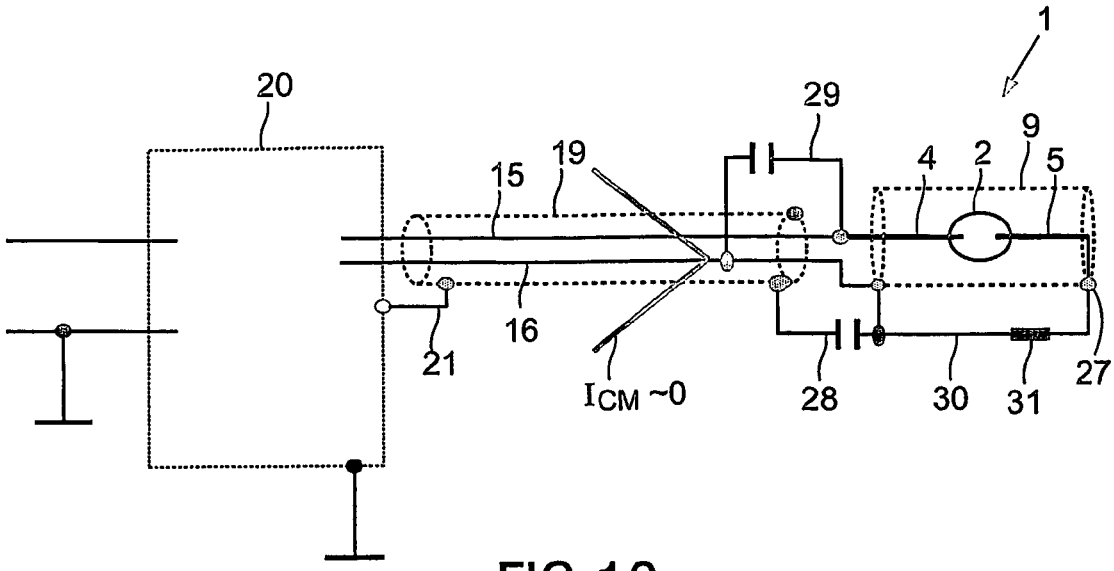
Figure 11:
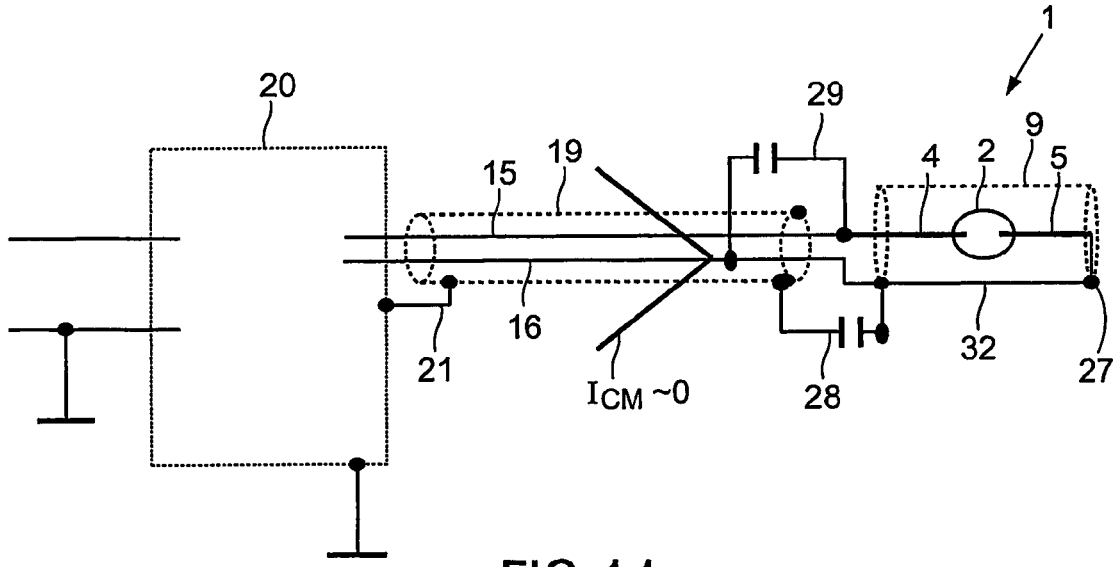

The invention will be explained in more detail below with reference to the appended Figures and to embodiments. Identical functional units have been given the same reference numerals in the Figures, in which:

FIG. 1 is an equivalent circuit diagram of a gas discharge lamp according to the prior art driven by an electronic lamp system, FIG. 2 is a diagrammatic longitudinal sectional view of a gas discharge lamp according to the invention in a first embodiment, FIG. 3 is an equivalent circuit diagram of the gas discharge lamp of FIG. 2, FIG. 4 is a diagrammatic longitudinal sectional view of a gas discharge lamp in a second embodiment, FIG. 5 is a diagrammatic longitudinal sectional view of a gas discharge lamp in a third embodiment, FIG. 6 is an equivalent circuit diagram of a gas discharge lamp of FIG. 4 or FIG. 5, FIG. 7 is a diagrammatic longitudinal sectional view of a gas discharge lamp according to the invention in a fourth embodiment, FIG. 8 is an equivalent circuit diagram of a gas discharge lamp of FIG. 7, FIG. 9 is a diagrammatic longitudinal sectional view of a gas discharge lamp according to the invention in a fifth embodiment, FIG. 10 is an equivalent circuit diagram of a gas discharge lamp of FIG. 9, FIG. 11 is an equivalent circuit diagram of a gas discharge lamp of a construction similar to that of the gas discharge lamp of FIG. 9.

The operating principle of the electrical components of a gas discharge lamp according to the prior art is clearly visible from the equivalent circuit diagram of FIG. 1.

Such a gas discharge lamp substantially comprises a discharge vessel 2 filled with an inert gas, into which electrodes 4, 5 are introduced from mutually opposed sides. The electrodes 4, 5 are connected to a driver circuit 20 via supply lines 15, 16. The driver circuit 20 is connected at one of its inputs to ground potential and at the other input to a voltage source which delivers the supply voltage. When such a gas discharge lamp is used in an automobile headlight, the supply voltage will usually be the automobile battery voltage.

The driver circuit is normally present in an electrically conductive, grounded housing 20, i.e. one that is at ground potential. The driver circuit is electromagnetically screened from its surroundings thereby. Similarly, the supply lines 15, 16 are passed to the gas discharge lamp inside a screening 19. This screening 19, as shown in FIG. 1, is usually connected to the housing 20 of the driver circuit via a suitable connection 21. The entire electrical system for operating the gas discharge lamp is thus screened by means of a screening at ground potential.

A high voltage is applied to the electrodes 4, 5 through the supply lines 15, 16 for ignition. This high voltage is generated from the input voltage in an ignitor, which is part of the driver circuit here. After ignition, the gas discharge lamp 1 is operated, for example, with a 400 Hz AC voltage, for example having peak voltages of 12 V and −73 V. This AC voltage is also generated by the driver circuit. The ignitor for generating the high voltage may alternatively be directly arranged at the lamp 1, for example in a separate housing directly adjoining the lampholder, or alternatively in the lampholder.

As is apparent from FIG. 1, the only non-screened part of the entire system is the gas discharge lamp 1 itself with its discharge vessel 2 and the electrodes 4, 5. This leads to undesirable parasitic capacitances $C_P$ between the lamp 1 or the electrodes 4, 5 acting as antennas and the surroundings of the lamp 1, for example a reflector. A high-frequency current may flow to the surroundings through these parasitic capacitances $C_P$, which is the equivalent of an electromagnetic high-frequency radiation. This so-called common mode current ICM, which corresponds to the difference between the current flowing to the lamp and the current flowing back, is represented by the large arrow point on the supply line 16 in the equivalent circuit diagram. It is greater than zero in a conventional lamp according to the prior art as shown in FIG. 1.

To reduce this common mode current and thus the intensity of the electromagnetic interference radiation of the lamp 1, according to the invention, the discharge vessel 2 is surrounded by an electrically conductive, translucent screening which screens off the discharge vessel 2 substantially entirely. This screening comprises suitable connection means, so that the screening will automatically be connected to the screening 19 of the electrical system used for operating the gas discharge lamp 1, at least as regards high frequencies, so as to form a coaxial screening system enclosing the discharge vessel 2 with the electrodes 4, 5 during operation of the gas discharge lamp 1.

FIG. 2 shows a first embodiment of a lamp 1 according to the invention. The lamp 1 shown herein is a typical MPXL (Micro Power Xenon Light) lamp 1. The lamps in the further embodiments are also assumed to be MPXL lamps 1. It is emphasized, however, that the invention is not limited to such MPXL lamps, but may be used in principle also for other types of gas discharge lamps, in particular other HID lamps.

As FIG. 2 shows, such an MPXL lamp 1 comprises an inner discharge vessel 2 (also denoted inner bulb or burner) which is usually made of quartz glass. A first electrode 4 and a second electrode 5 extend into the discharge vessel 2 in a usual manner, i.e. into an inner space 3 of the discharge vessel 2. The electrodes 4, 5 are enclosed adjacent end portions 6, 7 of the discharge vessel such that the inner space 3 is sealed off from the surroundings. The inert gas, xenon in this case, is present in the inner space 3 of the discharge vessel, which comprises only a few cubic millimeters, at a comparatively high pressure.

The discharge vessel 2 is surrounded by an outer bulb 8 which is filled with a gas, in particular air, and which is sealed against the ambient atmosphere for the purpose of absorbing inter alia ultraviolet radiation that arises in the discharge, which outer bulb is usually also made of quartz glass and is fixedly connected to the discharge vessel 2 at the end portions 6, 7 of this discharge vessel 2.

In the embodiment shown in FIG. 2, a conductive, translucent screening 9 is present on the outer side of the outer bulb 8. This screening may comprise, for example, a layer of conductive translucent material such as FTO (fluoride-doped tin oxide). Alternatively, for example, it may be a metal grid, which should not be too dense in order to transmit sufficient light. The discharge vessel 2 is fully screened off by this outer screening 9. The screening 9 is connected to an electrically conductive end cap 10 and a contact ring 11 at the respective end portions 6, 7. The gas discharge lamp 1 is held in a lampholder housing 17 (diagrammatically indicated only) by means of the end portion 7 comprising the contact ring 11. When being inserted into the lampholder, the lamp 2 automatically achieves a metal contact between the lampholder housing 17 and the screening 9 of the lamp 2. The metal lampholder housing 17 in its turn is connected to the screening of the driver circuit.

The insertion of the lamp 2 into the lampholder in addition provides a simultaneous connection between the electrode 4 and a supply line 15 leading to the driver circuit. The other electrode 5 is connected to the central lead 13 of a coaxial line 12, which is passed into the lampholder next to the discharge lamp and is connected there to a supply line 16 leading to the driver circuit 20. Contacting of the central lead of the coaxial line 12 and of the electrode with the supply lines 15, 16 takes place through conventional plug connections in each case, which are not shown here for simplicity's sake.

The outer lead 14 of the coaxial line is connected to the cover cap 10 at the upper end portion 6 of the discharge vessel 2, i.e. the portion remote from the lampholder, whereby a connection of the outer lead 14 of the coaxial cable 12 to the screening 9 of the gas discharge lamp 1 is achieved. The outer lead 14 of the coaxial cable is connected to the conductive housing of the lampholder 17 again via suitable contacts 18. The entire system including the discharge vessel 2 is thus screened off inside a coaxial line.

This kind of screening is once more clarified in the equivalent circuit diagram shown in FIG. 3 and accompanying the embodiment of FIG. 2. The construction of the electrical system for operating the lamp 1 is shown here in the same manner as in the equivalent circuit diagram of FIG. 1 for a prior art lamp. Now, however, the screening 9 on the bulb 8 and the screening 14 of the coaxial line connected to the former together ensure a full screening of the gas discharge lamp 1 as well as of the supply line 13 present in the vicinity of the gas discharge lamp. The screenings 9, 14 are connected directly to the screening of the electrical driver system of the lamp 1, i.e. to the screening 19 of the supply lines 15, 16, via suitable connection elements 11, 18 at both ends. The parasitic capacitances $C_P$ are thus connected between the electrodes 4, 5 and the screening 9. HF currents which could cause electromagnetic interference radiation are compensated for by the currents induced in the screenings 9, 14 which flow back through the screenings 19, 21, 20 of the electrical driver system. The total balance of the currents flowing towards the lamp 1 via the lines 15, 16 and the return currents flowing through these lines 15, 16 and the screening 19, indeed, contains a negligibly small common mode current $I_{CM}$, which is the equivalent of only a small emission of electromagnetic interference radiation.

FIG. 4 shows an alternative embodiment, in which the gas discharge lamp 1 comprises a further support structure 22, for example an additional quartz glass cylinder 22, outside the outer bulb 8. This quartz glass cylinder 22 is fixedly connected to the other components of the gas discharge lamp 1. A conductive layer or a grid forming a screening 23 is present on the outer or inner side of this additional quartz glass cylinder 22. The screening is preferably closed also at its end, unlike the representation given here, so that the discharge vessel 2 with its electrodes 4, 5 and the outer bulb 8 as well as a supply line 25 leading to the electrode 5 remote from the lampholder are completely screened off. The screening 23 on the additional quartz glass cylinder 22 is again connected to the conductive screening housing 17 of the lampholder via contact elements 24. The connection of the supply line 25, i.e. the electrode 4, to the supply lines 15, 16 coming from the driver circuit is achieved in a usual manner by means of plug connectors (not shown).

FIG. 5 shows an embodiment that is very similar to the embodiment of FIG. 4. Here, again, the electrode 5 remote from the lampholder is connected via a supply line 29 that is present inside the screening 9 surrounding the discharge vessel 2. The screening 9, however, is present directly on the wall of the outer bulb 8 of the gas discharge lamp 1, as in the embodiment of FIG. 2. The upper end portion 6 of the gas discharge lamp 1 is closed off with a conductive end cap 10 here, so that the screening 9 is fully closed around the gas discharge lamp 1. The supply line 26, for example in the form of a piece of wire, is fastened to the electrode 5 inside this end portion 6. From there it extends along the inner wall of the outer bulb 8 up to the end portion 7 at the lampholder side. There the supply line 26 is passed through the contact ring 11 parallel to the electrode 4 at the lampholder side, via which ring the screening 9 is again connected to the lampholder housing 17. The supply line 26 is connected in a usual manner to the supply lines 15, 16 coming from the driver circuit, as is the electrode 4. This embodiment has the advantage that no external supply lines need be provided to the end of the gas discharge lamp 1 remote from the lampholder, while on the other hand no additional support structure for the screening is necessary. Instead of a wire, the return line 26 may alternatively consist of a conductor track provided on the inner side of the wall of the outer bulb 8.

The discharge vessel 2 in the two latter examples is again fully enclosed with its electrodes 4, 5 in a coaxial screening system, however, a second supply line extends parallel to the other supply line to the electrodes inside the coaxial screening system, i.e. inside the outer screening. This is once more depicted in an equivalent circuit diagram for the embodiments of FIG. 4 and FIG. 5, as shown in FIG. 6. The construction of the electrical driver system and of the screening of the electrical driver system is identical again to what is shown in the equivalent circuit diagrams of FIG. 1 and FIG. 3. The difference with the embodiment of FIG. 3 is that the screening 9, 23 here surrounds the parallel supply lines and electrodes 4, 5 as an envelope closed at the ends, since the supply line leading to the electrode 5 remote from the lampholder is arranged parallel to the electrodes 4, 5 inside the screening 9, 23.

A comparison between the equivalent circuit diagram of FIG. 6 and the equivalent circuit diagram of FIG. 1 for a non-screened prior art lamp shows that again the parasitic capacitances $C_P$ are connected between the electrodes 4, 5 and the respective screens 9, 23, the latter two being again connected via a connection 11, 24 to the screening 19 of the supply lines 15, 16 leading to the driver circuit. The screening 19 is formed by the housing 17 of the lampholder at the lamp side in the example shown in FIGS. 4 and 5. Here, as in the embodiment of FIG. 3, the current balance is such that the high-frequency currents flowing through the parasitic capacitances $C_P$ are conducted back through the screening 19 again, so that the common mode current $I_{CM}$ is practically zero.

FIG. 7 shows an alternative embodiment which is of an even simpler construction than the preceding embodiments. Here the electrode 5 remote from the lampholder is connected via a contact 27 to the electrically conductive end cap 10 of the relevant end portion 6 at the end of this portion, and accordingly to the screening 9 present at the outer side of the outer bulb 8. The screening 9 here at the same time serves as a supply line or return line for the electrode 5. The screening 9 is again connected to a contact ring 11 present at the end portion 7 at the lampholder side. This contact ring 11, however, is not in metal contact with the conductive screening housing 17 of the lampholder here, but is in contact by means of one or several decoupling capacitors 28 of the highest possible capacitance. The ring contact 11 is in addition conductively connected to a supply line 16 coming from the driver circuit, so that a contact between the supply line 16 and the electrode 5 is achieved via the screening 9. The electrode 4 at the lampholder side is connected to the other supply line 15. Contacting with the supply lines 15, 16 again takes place in a usual manner known to those skilled in the art.

In addition, the screening 9 serving as a return line and the electrode 4 at the lampholder end are interconnected by means of a further decoupling capacitor 29 which may either form part of the lamp or may be integrated in the lampholder, and which may, for example, interconnect the supply lines 15, 16 at their ends.

An equivalent circuit diagram of this construction is shown in FIG. 8. As this equivalent diagram shows, the screening 9 serves as a connection between the electrode 5 and the supply line 16 coming from the driver circuit 20, i.e. the screening 9 itself forms part of this supply line. The HF currents generated by the gas discharge lamp 1, which are responsible for the electromagnetic interference radiation, are coupled out at the screening 19 of the electric system serving to supply the gas discharge lamp 1 via the decoupling capacitor or capacitors 28. This again results in a current balance in which the common mode current $I_{CM}$ is substantially zero, so that accordingly an electromagnetic interference emission into the surroundings may be disregarded as being negligeably small. The decoupling capacitor 29 additionally generates a HF short-circuit between the two supply lines 15, 16 in or immediately adjacent the lamp 1.

Since the screening 9 is used as a supply line here and is present at the outside of the outer bulb 8, it is particularly suitable to use such a construction for driver circuits in which the second electrode 5 remote from the lampholder can be connected to ground. In an alternative embodiment (not shown), the screening is provided in the interior of the wall of the outer bulb, or is present on the inner surface of the wall of the outer bulb. Since it is impossible in this construction to touch the screening, such a lamp is also suitable for the conventional AC operation.

FIG. 9 shows a somewhat modified version of the embodiment of FIG. 7. The essential difference with the embodiment of FIG. 7 here lies in the fact that a separate line 30, for example in the form of a wire, is connected to the supply line 16 from the contact location 27 parallel to the screening 9. A ferrite bead 31 acting as an inductive element is present in the line 30 in the immediate vicinity to the contact location 27 at the upper end cap 10 of the gas discharge lamp 1.

This construction is again shown in the equivalent circuit diagram of FIG. 10. The line 30 connected in parallel to the screening 9 serves to drain off higher currents necessary for operation, in particular for ignition of the lamp. This relates to low-frequency currents for which the resistance of the line formed by the screening 9 would be too high, because this screening 9 is formed only by a comparatively thin layer or a very coarse grid because of the required permeability to light. The parallel line 30 by contrast has a low ohmic resistance but a comparatively high self-inductance compared with the large-area screening 9, so that the impedance for high-frequency currents in this line is very high. Accordingly, the high-frequency currents will flow by preference through the screening 9 and the decoupling capacitor 28 towards the screening 17 of the lampholder and the screening 19 of the supply lines 15, 16, as envisaged. The ferrite bead 31 here acts as an additional low-pass filter for preventing a flow of the high-frequency currents through the parallel line 30, so that this line 30 will not act as an antenna again and send high-frequency interference radiation to the surroundings. It is only the low-frequency currents in the range of 400 Hz necessary for operation of the gas discharge lamp and the DC component that flow by preference through the separate line 30 of low resistance. This construction has the advantage that the screening 9 can be manufactured with an optimized translucence without having to offer a sufficient conductance for the low-frequency currents necessary for lamp operation.

FIG. 11 is an equivalent circuit diagram of a modification that shows only minor changes with respect to the embodiment shown in FIGS. 9 and 10. Here a thin conductor track is provided on the outer surface of the outer bulb 8 instead of a separate wire 30, having the same final effect as the parallel line 30 formed by a wire. Such a thin conductor track inside the screening layer may preferably also be used in all other embodiments for reducing the resistance of the layer and thus enhancing the effectiveness of the draining of the interference currents.

It is finally noted once more that the gas discharge lamps and their equivalent circuit diagrams shown in the figures are merely examples of embodiments which may be modified in many respects without departing from the scope of the invention. Thus, for example, the screening 9 may alternatively be arranged on the inner side of the outer bulb 8 in all embodiments, or may be formed by a special layer in the wall of the outer bulb 8. Similarly, the lamp may be retained in some manner other than by means of an end portion inserted into a lampholder, for example it may be connected to a coaxial cable or similar element at the side present in the lampholder in the embodiments.

The invention claimed is:

1. A gas discharge lamp with a discharge vessel;

electrodes projecting into the discharge vessel;

a translucent, electrically conductive first screening which screens the discharge vessel and comprises connection means for providing an at least high-frequency connection between the screening and a second screening of an electrical system used for operating the gas discharge lamp so as to form a coaxial screening system enclosing the discharge vessel with the electrodes during operation of the gas discharge lamp; and a conductor track, situated along a surface of the first screening that encloses the discharge vessel, having a lower omhic resistance than portions of the first screening that is employed to enhance the conductivity of the first screening.

2. The gas discharge lamp claimed in claim 1, wherein the gas discharge lamp comprises an outer bulb surrounding the discharge vessel, and the first screening comprises a layer of conductive translucent material or a grid structure of conductive material arranged in or on a wall of die outer bulb.

3. The gas discharge lamp claimed in claim 1, wherein the first screening has an at least high-frequency connection to the second screening of the electrical system used for operating the gas discharge lamp in two mutually opposed locations of the gas discharge lamp during operation thereof.

4. The gas discharge lamp claimed in claim 1, wherein at least one of the electrodes is electrically connected to a supply line comprising a third screening, and the first screening is connected with electrical conduction to the third screening.

5. The gas discharge lamp claimed in claim 1, wherein a supply line extends inside the first screening and is connected to one of the electrodes.

6. The gas discharge lamp claimed in claim 1, wherein the first screening is connected with electrical conduction to a third screening of a lampholder during operation of the gas discharge lamp.

7. A headlight or luminaire with a gas discharge lamp as claimed in claim 1 and with an electrical system for operating the gas discharge lamp, which system comprises the second screening, wherein the first screening is connected to the second screening at least as regards to high frequencies so as to form a coaxial screening system enclosing the discharge vessel and its electrodes.

8. A gas discharge lamp comprising:

a discharge vessel;

electrodes projecting into the discharge vessel;

a translucent, electrically conductive first screening which screens the discharge vessel and comprises connection means for providing an at least high-frequency connection between the first screening and a second screening of an electrical system used for operating the gas discharge lamp so as to form a coaxial screening system enclosing the discharge vessel with the electrodes during operation of the gas discharge lamp, wherein the first screening of the gas discharge lamp-serves as a power supply line and is electrically connected to one of the electrodes.

9. The gas discharge lamp as claimed in claim 8, wherein the electrode is connected to an additional supply line which is arranged in parallel to the first screening of the gas discharge lamp.

10. The gas discharge lamp as claimed in claim 9, wherein an inductive element included in the additional supply line.

11. The gas discharge lamp claimed in claim 8, wherein the first screening is coupled to a second screening of a lampholder via a capacitive component during operation of the gas discharge lamp.

12. The gas discharge lamp claimed in claim 8, wherein the first screening of the gas discharge lamp is connected to another electrode via a capacitive component.

13. A gas discharge lamp with a discharge vessel;

electrodes projecting into the discharge vessel; and a translucent, electrically conductive first screening which screens the discharge vessel and comprises connection means for providing an at least high-frequency connection between the first screening and a second screening of an electrical system used for operating the gas discharge lamp so as to form a coaxial screening system enclosing the discharge vessel with the electrodes during operation of the gas discharge lamp, wherein at least one of the electrodes is electrically connected to a supply line comprising a third screening within a coaxial cable, and the first screening is connected with electrical conduction to the third screening.

14. A gas discharge lamp comprising:

a discharge vessel;

electrodes projecting into the discharge vessel; and a translucent electrically conductive first screening which screens the discharge vessel and comprises connection means for providing an at least high-frequency connection between the first screening and a second screening of an electrical system used for operating the gas discharge lamp so as to form a coaxial screening system enclosing the discharge vessel with the electrodes during operation of die gas discharge lamp, wherein the first screening of the gas discharge lamp serves as a supply line and is electrically connected to one of the electrodes, wherein the at least one of the electrodes is connected to a main supply line, wherein die main supply line is electrically connected to an additional supply line that is branched from the main supply line and is arranged in parallel to and along a length of the first screening, and wherein an inductive element is included in the additional supply line.

15. A gas discharge lamp comprising:

a discharge vessel, electrodes projecting into the discharge vessel, a translucent, electrically conductive first screening which screens the discharge vessel and comprises connection means for providing an at least high-frequency connection between the first screening and a second screening of an electrical system used for operating the gas discharge lamp, so as to form a coaxial screening system enclosing the discharge vessel with the electrodes during operation of the gas discharge lamp;

wherein the first screening of the gas discharge lamp serves as a supply line and is electrically connected to one of the electrodes, and wherein the first screening of the gas discharge lamp is coupled to a screening of a lampholder via a capacitive component during operation of the gas discharge lamp.

16. A gas discharge lamp comprising:

a discharge vessel, electrodes projecting into the discharge vessel, a translucent, electrically conductive first screening which screens the discharge vessel and comprises connection means for providing an at least high-frequency connection between the first screening and a second screening of an electrical system used for operating the gas discharge lamp, so as to form a coaxial screening system enclosing the discharge vessel with the electrodes during operation of the gas discharge lamp, wherein the first screening of the gas discharge lamp serves as a supply line and is electrically connected to one of the electrodes, and wherein the first screening of the gas discharge lamp is connected to another one of the electrodes via a capacitive component.

* * * * *